US005131863A

United States Patent [19]

Gerke et al.

[11] Patent Number: 5,131,863

[45] Date of Patent: Jul. 21, 1992

[54] CUTTING/CLAMPING CONTACT

[75] Inventors: Dieter Gerke; Andrzey Janczak, both of Berlin, Fed. Rep. of Germany

[73] Assignee: Krone Aktiengesellschaft, Berlin, Fed. Rep. of Germany

[21] Appl. No.: 708,985

[22] Filed: May 31, 1991

[30] Foreign Application Priority Data

Jun. 1, 1990 [DE] Fed. Rep. of Germany ..... 4018164

[51] Int. Cl.[5] ..... H01R 4/24

[52] U.S. Cl. ..... 439/395; 439/391

[58] Field of Search ..... 439/391-407

[56] References Cited

U.S. PATENT DOCUMENTS

| | | | |
|---|---|---|---|
| 4,029,384 | 6/1977 | Reinwall, Jr. | 439/397 |
| 4,097,107 | 6/1978 | Hawkins | 439/397 |
| 4,153,324 | 5/1979 | Kukla | 439/397 |
| 4,648,673 | 3/1987 | Endo et al. | 439/395 |
| 4,682,835 | 7/1987 | Aujla et al. | 439/395 |

*Primary Examiner*—David Pirlot
*Attorney, Agent, or Firm*—McGlew & Tuttle

[57] ABSTRACT

The invention relates to a cutting/clamping contact (1) for contacting an insulated cable core (5), comprising two contact legs (2, 3) made of a blade-type, resilient metal material, between the inner sides (13, 14; 23, 24) of which an upwardly open contact slot (4) with an enlarged wire introduction section (7) is formed. In order to provide a cutting/clamping contact (1) which allows for contacting cable cores (5) having a thick insulation (6) as well as cable cores having a thin conductive core (12), in particular with a ratio of insulation to conductive core diameter larger than 3, the inner side (13, 14; 23, 24) of at least one contact leg (2, 3) comprises, in the wire introduction section (7) an inclined surface (8, 9) forming a cutting edge (10) directed into the wire introduction section (10).

8 Claims, 3 Drawing Sheets

FIG.3
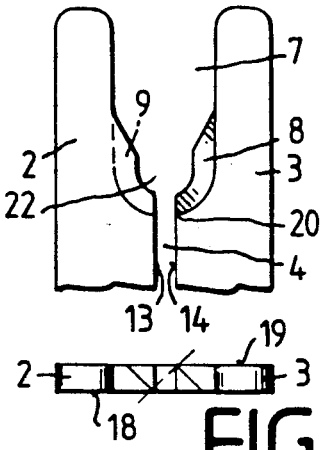
FIG.3a
FIG.4
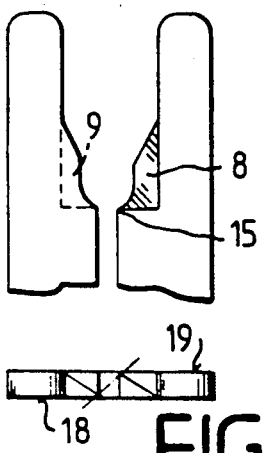
FIG.4a
FIG.5
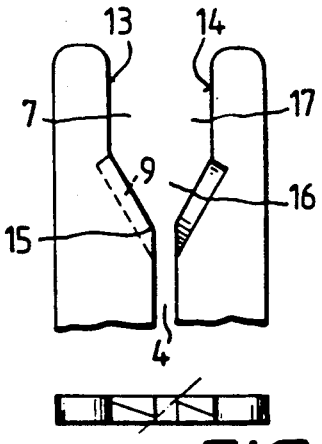
FIG.5a
FIG.6
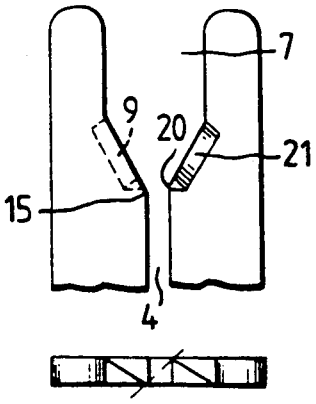
FIG.6a

CUTTING/CLAMPING CONTACT

FIELD OF THE INVENTION

The invention relates in general to a cutting/clamping contact for establishing a contact with an insulated cable core. In particular the cutting/clampinq contact includes two contact legs made of a blade-type, resilient metal material with an inner side inclined relative to a longitudinal axis of the cable core forming an upwardly open contact slot and an enlarged wire introduction section having a substantially V-shaped centering opening.

BACKGROUND OF THE INVENTION

From DE-PS 27 25 551, there is known in the art a cutting/clamping contact of the aforementioned species. The cutting/clamping contact comprises two contact legs of a blade-type, resilient contact material, between which a contact slot is formed being limited by the inner sides of the contact legs and to which a V-shaped wire introduction section is assigned. The width of the contact slot is smaller than the diameter of the conductive core of the cable core to be connected. The cutting/clamping contact is inserted into a plastic body, inclinedly to a clamping slot for the cable core, preferably under a 45° angle. When pressing the insulated cable core into the clamping slot of the plastic body, and thus into the contact slot by means of a tool, the contact legs limiting the contact slot will cut the insulation of the cable core through, and penetrate into the conductive core of the cable core. In this way a contact connection between the cutting/clamping contact and the cable core to be connected is established. Such a contact connection has the disadvantage, however, that when contacting cable cores with thick insulation, a one-side or none at all contact connection is established. This is particularly the case with cable cores, for which the ratio between insulation and wire diameter is larger than 3. Herein, particularly, a permanent deformation (torsion and bending) of the contact legs, and a reduction of the contact force can be expected. A cable core having a thick insulation will contact the sharp edges of the V-shaped wire introduction section of the cutting/clamping contact, which sharp edges are arranged inclinedly to the longitudinal axis of the cable core when wiring, earlier than a cable core having thin insulation. Thus, when wiring a cable core having a thick insulation, the effective contact force is smaller, and the maximum possible deformation or bending-out of the contact legs is larger than with cable cores having a thinner insulation.

When pressing a cable core having a thick insulation into the contact slot, the inner sides of the V-shaped wire introduction section do not have a sufficient cutting force to cut into the insulation. The inner sides will glide, therefore, on the surface of the insulation. The contact force and the permanent deformation or bending-out, resp., of the contact legs increases, the deeper the cable core is pressed in. With sufficiently large cutting force for cutting into the insulation, the inner sides of the contact legs are, however, so far away from the initial position that the contact spring travel is too small, and the contact slot too wide for the thin conductive core to contact the conductive core of the cable core.

SUMMARY AND OBJECTS OF THE INVENTION

It is an object of the invention to provide a cutting/clamping contact of the type mentioned hereinbefore, which allows for contacting cable cores having a thick insulation as well as cable cores having a thin conductive core, in particular with a ratio of insulation to conductive core diameter larger than 3, in a safe, dependable and reliable manner.

According to the invention, a cutting/clamping contact element is provided for contacting an insulated cable core. The contact element is formed of two contact legs made of a blade-type resilient metal material. The two contact legs are set at an angle with respect to a longitudinal axis of the cable core. The two contact legs define an inner side forming an upwardly open contact slot, an enlarged wire introduction section determining therein and having a substantially V-shaped centering opening. The inner side of at least one contact leg comprises an area of the V-shaped centering opening and includes an inclined surface extending between a front side and a rear side of the contact leg. The inclined surface forms a wedge-shaped cutting edge directed into the area of the V-shaped centering opening on the front or rear side of the contact leg and a cutting tip in the initial area of the contact slot.

By the inclined surfaces within the wire introduction section, considerably smaller cutting forces are required to cut from both sides into the cable core when pressing it into the contact slot. Therein, deformation or bending-out of the contact legs and sliding of the inner sides of the contact legs on the external jacket of the insulation are avoided. A deeper penetration of the wire introduction section into the insulation and into the conductive core of the cable core allows, together with the larger contact force, for a safe and dual side contact of cable core having a thick insulation and a thin conductive core. Due to the inclined surfaces, there is further obtained a reduced wiring force.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 3*a* is a front view according to the embodiment of FIG. 1;

FIG. 3*b* is a top view according to the embodiment of FIG. 1;

FIG. 4*a* is a front view according to the embodiment of FIG. 2;

FIG. 4*b* is a top view according to the embodiment of FIG. 2;

FIG. 5*a* is a front view of a cutting/clamping contact according to a third embodiment of the invention;

FIG. 5*b* is a top view according to the embodiment of FIG. 5*a;*

FIG. 6*a* is a front view of the cutting/clamping contact according to a fourth embodiment of the invention;

FIG. 6*b* is a top view according to the embodiment of FIG. 6*a;* and

DETAILED DESCRIPTION OF THE PREFERRED EMBODIMENT

Figure 1:
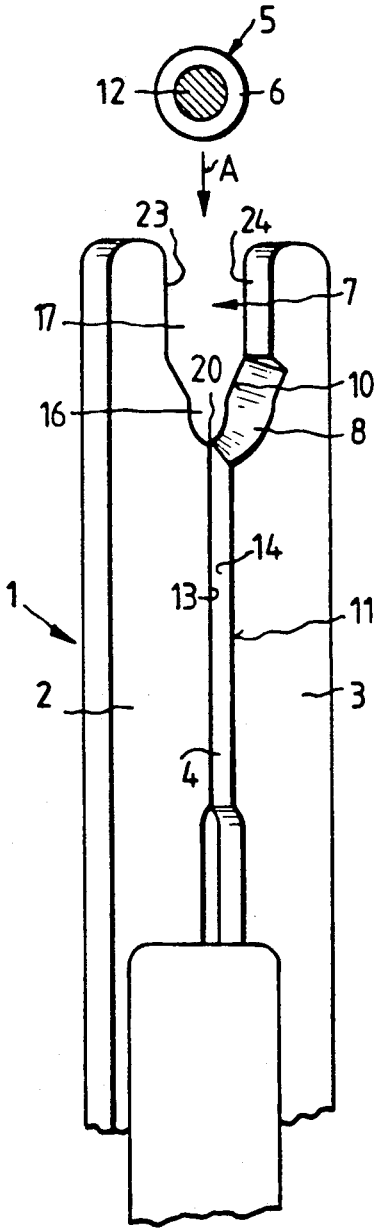
FIG. 1 is a perspective representation of a cutting/clamping contact according to a first embodiment of the invention with a cable core arranged thereupon.

The cutting/clamping contact composed of a blade-type metal material comprises two contact legs 2, 3 spaced from each other and forming, between their inner sides 13, 14, a contact slot 4.

In the upper section of the cutting/clamping contact 1 there is arranged inclinedly to a cable core 5, a wire introduction section 7 terminating in the contact slot 4. This wire introduction section 7 is formed with the inner sides 23, 24 of the contact legs 2, 3. The wire introduction section 7 includes an enlarged introduction opening 17. The inner sides 23, 24 of the opening 17 are arranged in parallel to each other, and a substantially V-shaped centering opening 16 follows upon the introduction opening 17 and is extended up to the upper edge 15 of the contact slot 4.

Within the centering opening 16 of the wire introduction section 7, at the inner sides 23, 24 of the contact slot 2, 3, there are provided inclined surfaces 8, 9 extending between the rear wall 19 and the front side 18 of the cutting/clamping contact 1. The inclined surfaces 8, 9 are arranged such that they will end either at the upper edge 15 of the contact slot 4, FIGS. 4 and 6, or within the contact slot 4, FIGS. 1 and 3. By the inclined surfaces 8, 9, wedge-type cutting edges 10 of the centering opening 16 of the wire introduction section 7, and cutting tips 20 at the upper edges 15 of the contact slot 4 are provided.

In the first two embodiments according to FIGS. 1 to 4, the centering opening 16 comprises a circular introduction section 22.

Figure 2:
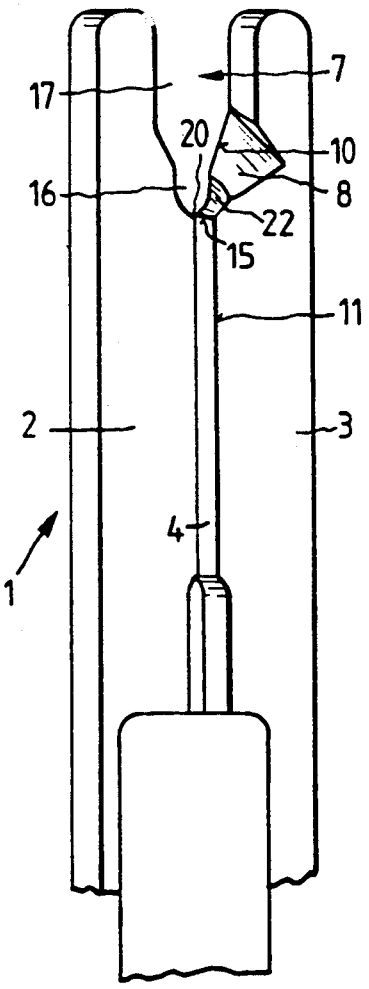
FIG. 2 is a perspective representation of the cutting/clamping contact according to a second embodiment of the invention.

In the first embodiment according to FIGS. 1 to 3, the inclined surfaces 8, 9 terminate within the contact slot 4, so that, within the contact slot 4, there is formed a cutting tip 20 at each inner wall 13, 14. Each leg 2, 3 of the cutting/clamping contact 1 comprises, in the wire introduction section 7, an inclined surface 8, 9, such inclined surfaces being disposed diametrically opposed, such that the cutting edges 10 and the cutting tips 20 are located, respectively, on the front side 18 of the one leg 2, and on the rear side 19 of the other leg 3 of the cutting/clamping contact 1.

In FIGS. 2 and 4, the second embodiment is represented, wherein the inclined surfaces 8, 9 terminate at the beginning of the contact slot 4 of the upper edge 15, such that the cutting tips 20 are formed directly at the beginning of the contact slot 4.

In FIGS. 5 and 6, the third and fourth embodiments are represented, wherein the centering opening 16 is V-shaped, and the inclined surfaces 8, 9 are formed of rectangular surfaces 21, which in the same manner as in the previous embodiments, terminate either according to FIG. 5 within the contact slot 4, or according to FIG. 6 at the upper edge 15 of the contact slot 4. The centering opening 16 has, in contrast to the other embodiments, no circular introduction section 22.

In the following, based on FIG. 7, wiring of a cutting/clamping contact 1 with a cable core 5 is described in more detail. The cable core 5 is introduced from top into the wire introduction section 7, as indicated by the arrow A in FIG. 7. The cutting/clamping contact 1 is inserted under 45° inclinedly to a clamping slot 25 into a cutout 27 of a plastic body 28. In the clamping slot 25 there are provided clamping cams 26 for clamping the insulation 6 of the cable core 5 fast. The cutout 27 clamps the outer edges 29 of the contact legs 2, 3 fast, and permits a free space of movement to the inner edges 30 of the contact legs 2, 3. The distance of the parallel inner sides 23, 24 of the contact legs 2, 3 is, in the introduction opening 17 of the wire introduction section 7, larger than the outer diameter D of the cable core 5.

The distance of the parallely disposed inner sides 13, 14, i.e. the width W of the contact slot 4 of the cutting/clamping contact 1, is smaller than the diameter d of the conductive core 12 of the cable core 5. In the inerposed centering opening 16, the cable core 5 is centered relative to the contact slot 4, so that the conductive core 12 of the cable core 5 will be introduced precisely centrally into the contact slot 4.

Figure 7:
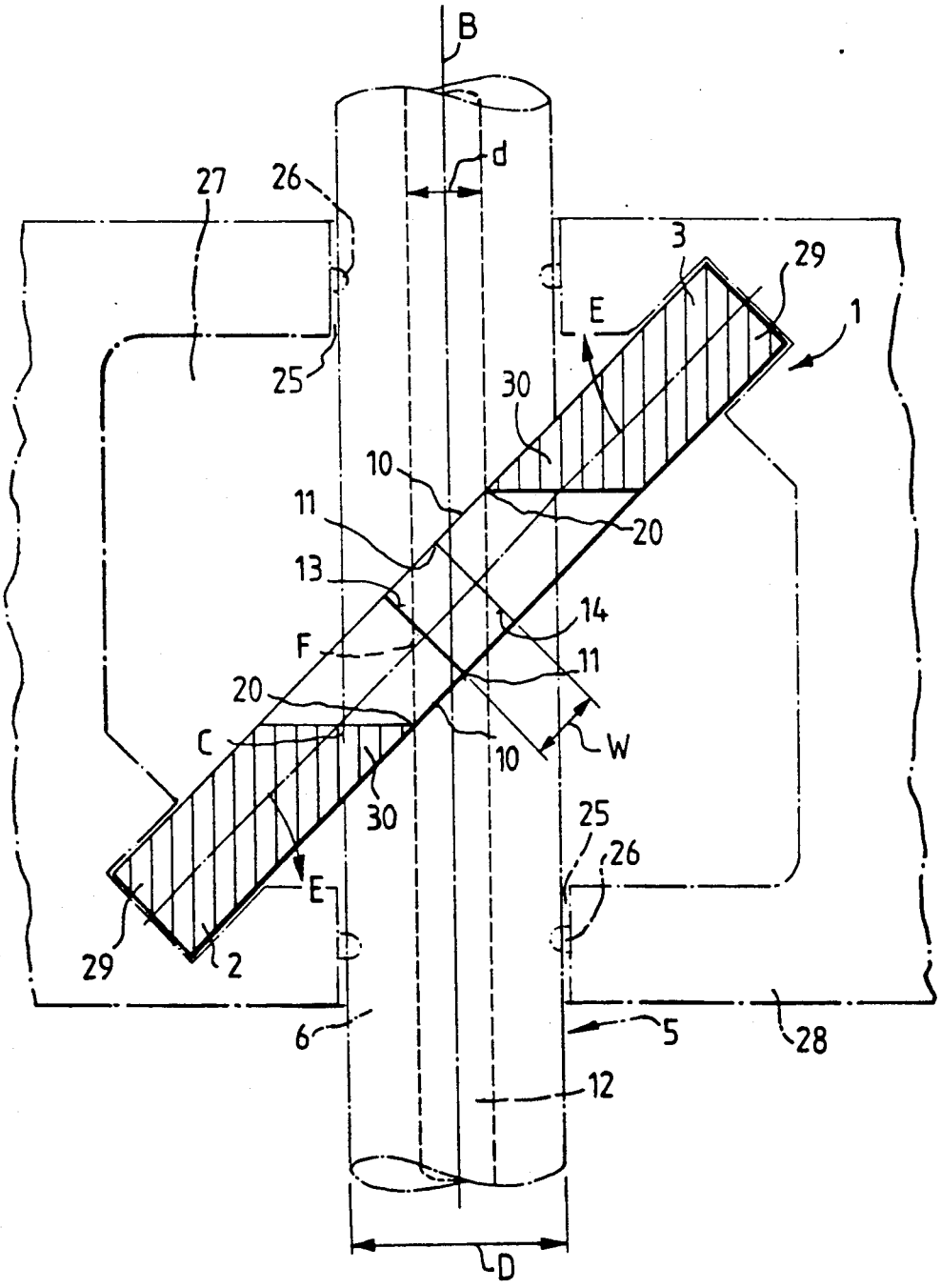
FIG. 7 is a top view of a cutting/clamping contact inserted into a plastic body, with pressed-in cable core.

As is shown in FIG. 7, when pressing the cable core 5 into the wire introduction section 7, by means of a non-shown press-in tool, of the centering opening 16, first the cutting edges 10 will immediately penetrate into the insulation 6, without sliding of the cutting edges 10 on the outer jacket of the cable core 5 being possible. Further, by an inclined positioning of the cutting/clamping contact relative to the axis of the cable core, it is achieved that the diametrically opposite cutting edges 10 will penetrate staggered into the insulation 6 of the cable core 5. If, now, the conductive core 12 of the cable core 5 is pressed into the contact slot 4, the cutting tips 20 and the inner edges 11 of the inner sides 13, 14 of the contact legs 2, 3 will penetrate into the conductive core 12 of the cable core 5, and establish a contact connection between the cutting/clamping contact 1 and the cable core 5.

By the inclined surfaces 8, 9 it is achieved in an advantageous manner that in the wire introduction section 7, sliding of the inner sides 13, 14 on the outer jacket of the insulation 6 is avoided. The contact legs 2, 3 cannot be twisted relative to each other, thus an enlarging of the contact slot 4 being prevented. It is guaranteed, thus, that the conductive core 12 will be cut in, even with very small diameter, by the inner edges 11 of the contact slot 4.

In FIG. 7 is shown, further, that the cutting tips 20 cut into the insulation in the areas C, thus the contact legs 2, 3 being guided in the insulation 6, until the sharp inner edges 11 of the contact slot 4 cut into the conductive core 12 in the areas F. Twisting the contact legs 2, 3 in the direction of the arrow E is thus prevented by the inclined surface 8, 9.

While specific embodiments of the invention have been shown and described in detail to illustrate the application of the principles of the invention, it will be understood that the invention may be embodied otherwise without departing from such principles.

What is claimed is:

1. A cutting/clamping contact element for contacting an insulated cable core, comprising:

two contact legs made of a blade-type resilient metal material, said two contact legs being disposed in a substantially similar plane at an angle relative to a longitudinal axis of the insulated cable core, said two contact legs defining inner sides providing an upwardly open contact slot with an enlarged wire introduction section, said enlarged wire introduction section terminating in said upwardly open contact slot, said upwardly open contact slot having a substantially V-shaped centering opening, said inner side of at least one of said contact legs including in an area of said substantially V-shaped centering opening, an inclined planar surface extending entirely from a front side to a rear side of said contact leg to form a wedge-shaped cutting edge directed into an area of said V-shaped centering opening on one of said front or rear side of one of said contact legs and a cutting tip in an upper area of said contact slot; and cable core holding means for holding the insulated cable core and said contact legs at said angle relative to said longitudinal axis of the insulated cable core, said cable core means surrounding said two contact legs and said cable core means defining a cut-out for receiving the insulated cable core.

2. A cutting/clamping contact element according to claim 1, wherein said inner sides of said two contact legs comprise diametrically opposite inclined planar surfaces arranged on one of said front and said rear side of said contact legs, each of said contact legs include a cutting tip.

3. A cutting/clamping contact element according to claim 1, wherein said inclined planar surface terminates at an upper edge of said contact slot.

4. A cutting/clamping contact element according to claim 1, wherein said inclined planar surface terminates within said contact slot of the cutting/clamping contact.

5. A cutting/clamping contact element in accordance with claim 1, wherein:

said cable core holding means defines another cut-out for receiving the insulated cable core at a spaced location from said cut-out, said cut-out being positioned on a side of said two contact legs, said side being substantially opposite another side of said two contact legs having said another cut-out.

6. A cutting/clamping contact element for contact an insulated cable core, the cutting/clamping contact element comprising:

a first contact leg made of a blade-type resilient metal material;

a second contact leg made of a blade-type resilient metal material, and positioned in a substantially identical plane as said first contact leg, said second contact leg positioned spaced from said first contact leg and defining an open contact slot between said first and second contact legs, said first and second contact legs defining an enlarged wire introduction section at one end of said open contact slot, said first and second contact legs also defining a substantially V-shaped centering opening between said open contact slot and said enlarged wire introduction section, said first contact leg having an inclined planar surface extending linearly from a front side to a rear side of said first contact leg, said inclined planar surface forming a first wedge-shaped cutting edge means for cutting insulation when the insulated cable is inserted into said V-shaped center opening, said first wedge-shaped cutting edge means being positioned in an area of said V-shaped centering opening, said second contact leg having an inclined planar surface linearly extending entirely from a rear side to a front side of said second contact leg to form a second wedge-shaped cutting edge means for cutting insulation when the insulated cable core is inserted into said V-shape center opening, said second wedge-shaped cutting edge means being in said area of said V-shaped centering opening, said second wedge shaped cutting edge means being substantially opposite and substantially complimentary to said first wedge-shaped cutting edge means, said first wedge-shaped cutting edge means being on a rear side of said first contact leg and said second wedge-shaped cutting edge being on a front side of said second contact leg;

a first cutting tip means for penetrating a core of the insulated cable core after said first wedge-shaped means has cut through said insulation said first contact tip means being positioned between said contact slot and said substantially V-shaped centering opening on said first contact leg;

second cutting tip means for penetrating said core of the insulated cable core after said second wedge-shaped means has cut through said insulation, said second contact tip being positioned between said contact slot and said substantially V-shaped center opening on said second contact leg; and cable core holding means for holding said first and second contact legs in said substantially identical plane at an angle relative to a longitudinal axis of the insulated cable core, said cable core holding means positioned said first and second contact legs for said first wedge-shaped cutting means and said first cutting tip means to penetrate the insulated cable core at a first wire location, said cable core holding means also positioning said first and second contact legs for said second wedge-shaped cutting edge means and said second cutting-tip means to penetrate the insulated cable core at a second wire location, said second wire location being longitudinally spaced from said first location.

7. A cutting/clamping contact element in accordance with claim 6, wherein:

said angle relative to said longitudinal axis is less than 90°.

8. A cutting/clamping contact element in accordance with claim 6, wherein:

said angle relative to said longitudinal axis is substantially 45°.

* * * * *